US007026049B2

(12) United States Patent
Endo et al.

(10) Patent No.: US 7,026,049 B2
(45) Date of Patent: Apr. 11, 2006

(54) CONDUCTIVE POLYVINYL ALCOHOL FIBER

(75) Inventors: Ryokei Endo, Kurashiki (JP); Tetsuya Hara, Kurashiki (JP); Akio Ohmori, Kurashiki (JP); Tomoyuki Sano, Kurashiki (JP)

(73) Assignee: Kuraray Co., Ltd., Kurashiki (JP)

( * ) Notice: Subject to any disclaimer, the term of this patent is extended or adjusted under 35 U.S.C. 154(b) by 25 days.

(21) Appl. No.: 11/060,556

(22) Filed: Feb. 18, 2005

(65) Prior Publication Data

US 2005/0181206 A1 Aug. 18, 2005

(30) Foreign Application Priority Data

Feb. 18, 2004 (JP) ..... 2004-041041

(51) Int. Cl.

| | |
|---|---|
| ***D01F 6/00*** | (2006.01) |
| ***D01F 6/14*** | (2006.01) |
| ***D01F 8/00*** | (2006.01) |
| ***B28B 11/08*** | (2006.01) |

(52) U.S. Cl. ..... 428/372; 428/370; 428/373; 428/374; 264/185; 264/291

(58) Field of Classification Search ..... 428/372, 428/374, 370, 373; 264/185, 291
See application file for complete search history.

(56) References Cited

U.S. PATENT DOCUMENTS 4,336,028 A 6/1982 Tomibe et al.
4,743,505 A * 5/1988 Yamada et al. ..... 428/373
5,244,731 A * 9/1993 Saito et al. ..... 428/372
5,455,114 A * 10/1995 Ohmory et al. ..... 428/364
5,840,423 A * 11/1998 Sano et al. ..... 428/364
6,066,396 A * 5/2000 Inada et al. ..... 428/370

OTHER PUBLICATIONS

Machine Translation: Patent Abstracts of Japan; JP 63-249185.
Machine Translation: Patent Abstracts of Japan: JP 04-289876.
Machine Translation: Patent Abstracts of Japan: JP 04-289877.
Machine Translation: Patent Abstracts of Japan: JP 61-075810 (JP-8-29887).
Machine Translation: Patent Abstracts of Japan: JP 52-144422.
Machine Translation: Patent Abstracts of Japan: JP 2002-212829.
Machine Transalation: Patent Abstracts of Japan: JP 57021570 (correpsonds to US 4,336,028 A1).
Machine Translation: Patent Abstracts of Japan: JP 59-108043.
Machine Translation: Patent Abstracts of Japan: JP 07-179769.

* cited by examiner

*Primary Examiner*—N. Edwards
(74) *Attorney, Agent, or Firm*—Oblon, Spivak, McClelland, Maier & Neustadt, P.C.

(57) ABSTRACT

A conductive polyvinyl alcohol fiber having good mechanical properties and heat resistance contains a polyvinyl alcohol polymer and copper sulfide nano-particles having a mean particle size of at most 50 nm which are finely dispersed in the polymer. The content of the nano-particles in the fiber is at least 0.5% by mass/polyvinyl acohol polymer, and the degree of polymer orientation is at least 60%.

20 Claims, 2 Drawing Sheets

[Fig. 1]
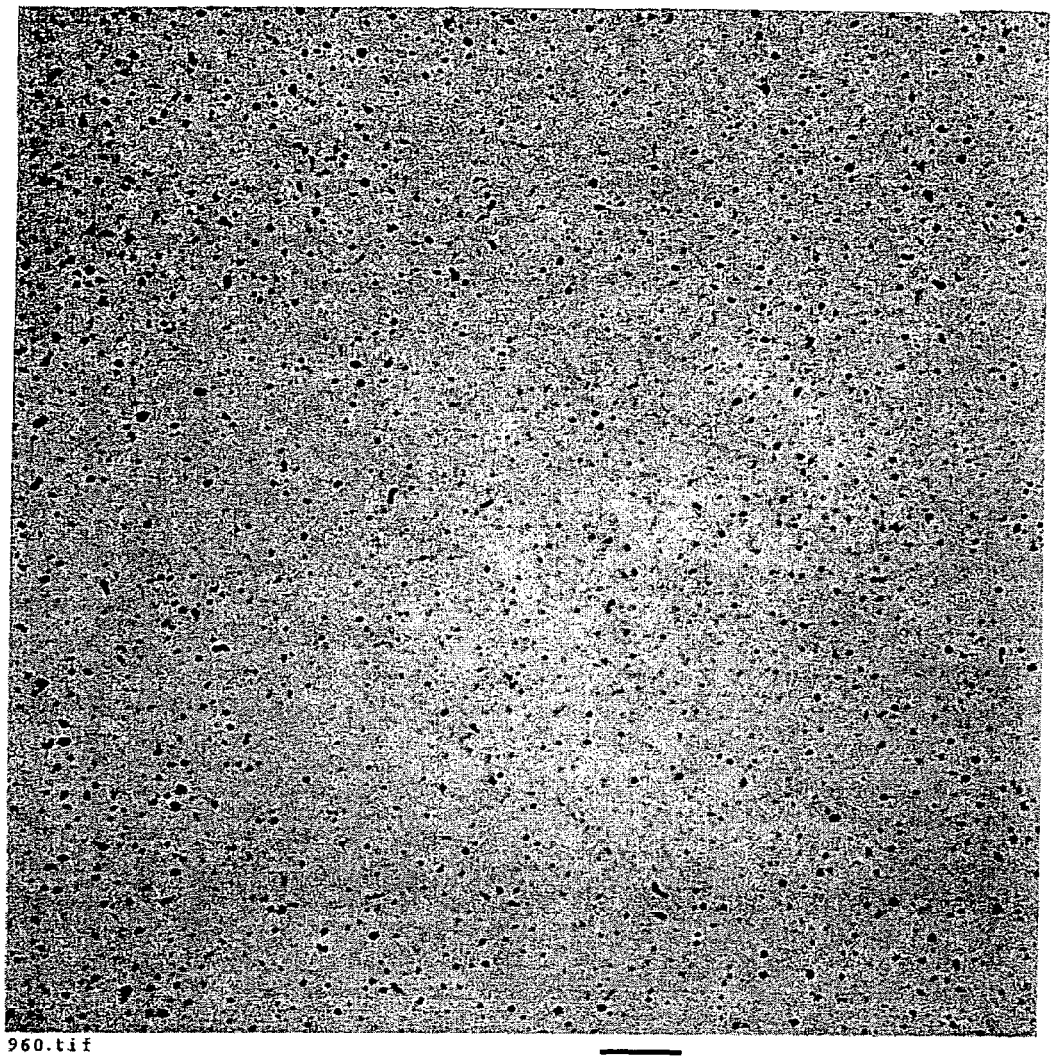
960.tif
Print Mag: 137000x @ 7. in
100 nm
HV=100kV
Direct Mag: 80000x
AMT Camera System 【Fig. 2】
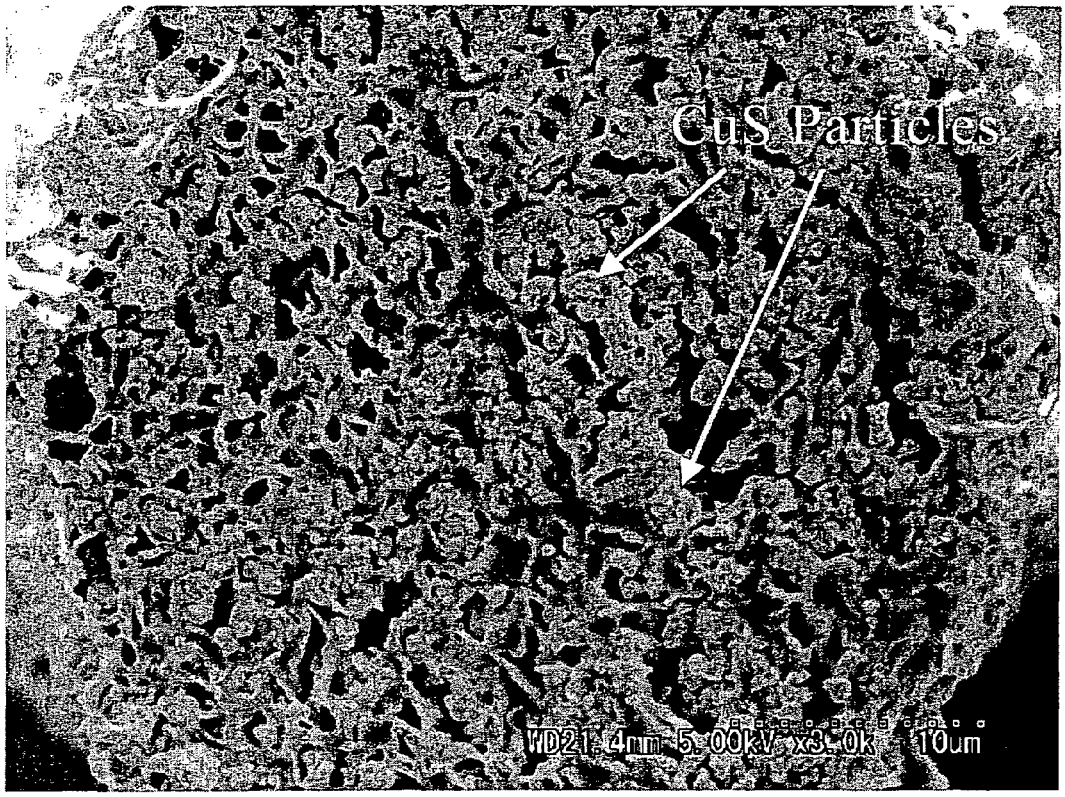

CONDUCTIVE POLYVINYL ALCOHOL FIBER

BACKGROUND OF THE INVENTION

1. Field of the Invention

The present invention relates to a conductive polyvinyl alcohol (hereinafter abbreviated to PVA) fiber having good mechanical properties such as strength and elasticity, and having good heat resistance and conductivity, to a method for producing the fiber, and to a conductive fabric comprising the fiber.

2. Discussion of the Background

A method has been proposed for producing a conductive synthetic fiber which comprises adding conductive filler such as carbon black to a synthetic fiber. Such conductive fibers are widely used in various industrial fields because they are relatively inexpensive and suitable for industrial mass production. For example, they are widely used for charging and discharging brushes in static duplicators. The temperature inside the duplicators becomes high due to the heat in fixation, and the conductive fibers for these applications are desired not to be deformed even when exposed to heat for a long period of time.

Most popular synthetic fibers such as polyester fibers, polyamide fibers, acrylic fibers and melt-spun polyolefin fibers are unsatisfactory in heat resistance and shape stability at high temperatures, and therefore conductive regenerated cellulose fibers are widely used for such applications (e.g., see JP-A 63-249185, JP-A 4-289876, JP-A 4-289877 and JP-B 1-29887). However, conductive cellulose fibers have poor mechanical properties, and therefore can not satisfy the requirement for high-quality properties such as good workability in producing charging brushes and discharging brushes and good durability during long-time service of products.

On the other hand, using PVA fibers having good heat resistance and good mechanical properties as conductive fibers for these applications has been proposed (e.g., see JP-A 52-144422). However, the conductive PVA fibers have problems because they are produced by adding a large amount of conductive filler having a size of 50 μm or so to the spinning solution containing the PVA. The filler may precipitate and deposit in the spinning solution and the stability of the production process is low. The drawing performance of the filler-containing fibers is extremely bad compared to that of filler-free fibers. As a result, even though the fibers can be conductive, their mechanical properties such as strength and elasticity are worsened.

Further, another method of producing conductive PVA fibers that are free from the problems of process capability and quality has been proposed. In this, the mean particle size of the conductive filler such as carbon black to be added to the spinning solution is reduced, and a polyoxyalkylene-type nonionic dispersant is further added to the spinning solution to thereby prevent the filler from precipitating and depositing in the spinning solution (e.g., see JP-A 2002-212829). In this method, the particle size of the conductive filler may be reduced to 1 μm or so, and it is favorable from the viewpoint that the surface area of the particles is increased so as to make the fibers conductive. However, the necessary amount of the filler to obtain the desired conductivity is at least ten % or more, and it is still problematic in that the filler may precipitate in the spinning solution and the drawing performance of the fibers is poor.

The popularity of mobile phones and electronic appliances has increased in recent years. However, various problems due to electromagnetic waves from them have been discussed, for example, their influences on human bodies and on errors of other electronic appliances. A conductive fabric is well used as an electromagnetic wave shield for mobile phones and electronic appliances. In this application, however, the fabric must have higher conductivity, and the above-mentioned conductive filler-introduced fibers can not act as shields. On the other hand, a metal coating layer can be formed on the surface of a fabric of light and flexible synthetic fiber by a vacuum evaporation method, a sputtering method or an electroless plating method. However, the metal film formed by such a method has problems because its physical properties such as abrasion resistance and weather resistance are worsened due to the chemical change thereof during long-time use. Accordingly, it is desired to further improve the metal film-coated fabric. Further, the conductivity treatment according to the method is extremely expensive and the practical use of the method is therefore limited.

Apart from the above-mentioned method of adding conductive filler to the spinning solution or adding it in the step of preparing the spinning solution, a different method has been proposed widely for producing fibers of higher conductivity. For example, a copper compound such as cupric chloride is applied to a polyacrylonitrile fiber so as to be adsorbed by the surface of the fiber, and then it is reduced with a sulfide to thereby form a thin, conductive copper sulfide layer on the surface of the fiber (e.g., see JP-A 57-21570, JP-A 59-108043). The conductive fiber obtained by the method has copper sulfide bonded to its surface, in an amount of from 5 to 15% by mass relative to the fiber, via a copper ion-trapping group such as a cyano group or a mercapto group existing in the surface of the fiber. In addition, the fiber has a thin coating layer on its surface and therefore exhibits high conductivity. However, the fiber exhibits its conductivity only close to the thin surface-coating layer of copper sulfide having a thickness of 100 nm or so, and therefore its durability is poor. In addition, in order to make the surface of the fiber adsorb the desired amount of copper sulfide thereon, high-temperature and long-time treatment is necessary. Further, the above-mentioned cyano group and mercapto group have a good ability to trap monovalent copper ions, and therefore the divalent copper salt must be intentionally reduced into monovalent copper ions for them. These steps are expensive, and the method has various problems in these points.

For solving the problem of improving the conductivity and the durability of the fibers, a method of infiltrating copper sulfide particles into the depth of fibers has been proposed, in which a sulfide dye-containing polymer material is used for fiber formation and copper sulfide is bonded to the polymer via the sulfide dye in the fibers formed (e.g., see JP-A 7-179769). In the Examples of JP-A 7-179769, conductive PVA fibers are proposed. To attain its object, the method indispensably comprises a step of preparing a sulfide dye-containing polymer material and a step of bonding copper sulfide to the sulfide dye-containing polymer material to give a conductive polymer material. However, the method is still problematic in that it requires some wet-heat treatments and is therefore complicated. The PVA fibers will be swollen during the treatments, and even if they can be conductive, their mechanical properties are worsened and, as a result, they can not be formed into fabrics. Still another problem with the method is that a sulfide dye is indispensable for infiltrating copper sulfide particles into the depth of fibers, and which is expensive.

Another method has been proposed for making a polymer material conductive, which has an amido group and a hydroxyl group (e.g., see JP-A 59-132507). The method comprises dipping a shaped article in an aqueous solution of a mixture of a copper salt and a reducing agent having mild sulfidizing ability, at a high temperature for a long period of time to thereby form a conductive copper sulfide layer to the depth of the shaped article. In fact, however, the copper sulfide layer can exist only in the vicinity of the surface of the shaped article, and therefore, the conductivity of the shaped article processed according to the method is low. Specifically, since the copper salt and the sulfidizing reducing agent in the aqueous solution are directly reacted with each other at a high temperature for a long period of time, the formed copper sulfide particles grow large and, as a result, the dispersed particle size inside the shaped article is inevitably large. In this respect, the method is not for internal conductivity generation but rather essentially for surface conductive layer formation. Accordingly, the method has various problems in that not only the conductivity of the product is low but also the durability thereof is poor, and the process cost is high. Given that situation, it is now desired to develop PVA fibers that have good mechanical properties such as good strength and elasticity intrinsic to PVA fibers and additionally have good electroconductivity, and to propose an inexpensive method for producing them.

SUMMARY OF THE INVENTION

It is therefore an object of the present invention to provide a PVA fiber having good conductivity and durability, while maintaining the properties of conventional PVA fibers, for example, mechanical properties such as strength and elasticity, as well as heat resistance.

It is another object of the present invention to provide a method for producing the above PVA fiber.

It is yet another object to provide a conductive fabric comprising the PVA fiber.

This and other objects have been achieved by the present invention the first embodiment of which includes a conductive polyvinyl alcohol fiber, comprising:

a polyvinyl alcohol polymer; and copper sulfide nano-particles having a mean particle size of at most 50 nm which are finely dispersed in the polymer;

wherein the content of the nano-particles in the fiber is at least 0.5% by mass/polyvinyl acohol polymer; and wherein a degree of polymer orientation is at least 60%.

In another embodiment, the present invention relates to a method for producing the above conductive polyvinyl alcohol fiber, comprising:

1) leading a polyvinyl alcohol fiber that is swollen to contain from 20 to 300% by mass, relative to polyvinyl alcohol, of a bath solvent, through a bath that contains from 10 to 200 g/liter of a copper ion-containing compound dissolved therein, thereby obtaining a fiber in which the copper ion-containing compound has uniformly infiltrated into the depth of the fiber, and 2) leading the fiber through a bath that contains from 1 to 100 g/liter of a sulfide ion-containing compound dissolved therein to attain copper sulfurization and reduction, thereby forming fine copper sulfide nano-particles having a mean particle size of at most 50 nm inside the fiber, wherein an overall draw ratio of the fiber in said process is at least 3 times.

In another embodiment, the present invention provides a conductive fabric, comprising:

the above conductive polyvinyl alcohol fiber.

BRIEF DESCRIPTION OF THE DRAWINGS

FIG. 1 is a microscopic photograph of the PVA fiber of the present invention, in which copper sulfide nano-particles are nano-dispersed.

FIG. 2 is a microscopic photograph of a conventional PVA fiber, in which copper sulfide particles are not nano-dispersed.

DETAILED DESCRIPTION OF THE INVENTION

The inventors of the present invention have found that surprisingly a PVA fiber having good mechanical properties and good conductivity can be produced inexpensively by infiltrating a copper ion-containing compound into a fiber in an ordinary fiber-producing process not requiring any expensive equipment for PVA polymer, and by subjecting the fiber to copper sulfurization and reduction to thereby form copper sulfide nano-particles finely dispersed inside the fiber.

Specifically, the present invention provides a conductive PVA fiber comprising a PVA polymer and copper sulfide nano-particles having a mean particle size of at most 50 nm which are finely dispersed in the polymer. The content of the nano-particles in the fiber is at least 0.5% by mass/PVA polymer and the degree of polymer orientation is at least 60%. Preferably, the volume intrinsic resistivity of the conductive PVA fiber is from $1.0\times10^{-3}$ to $1.0\times10^{8}$ Ω·cm. More preferably, the content of the copper sulfide nano-particles in the conductive PVA fiber is from 0.5 to 50% by mass/PVA polymer. The content of nanoparticles in the fiber includes all values and subvalues therebetween, especially including 1, 2, 3, 4, 5, 6, 7, 8, 9, 10, 15, 20, 25, 30, 35, 40, 45, 50, 55, 60, 65, 70, and 75% by mass/PVA polymer. The degree of polymer orientation includes all values and subvalues therebetween, especially including 65, 70, 75, 80, 85, 90, 95 and 100%. The volume intrinsic resistivity of the conductive PVA fiber includes all values and subvalues therebetween, especially including $5.0\times10^{-3}$, $1.0\times10^{-2}$, $5.0\times10^{-2}$, $1.0\times10^{-1}$, $5.0\times10^{-1}$, 1.0, 5.0, 10, 50, 100, 500, 1000, 5000, $1.0\times10^{4}$, $5.0\times10^{4}$, $1.0\times10^{5}$, $5.0\times10^{5}$, $1.0\times10^{6}$, $5.0\times10^{6}$, $1.0\times10_{7}$, and $5.0\times10^{7}$ Ω·cm.

The present invention also provides a method for producing the PVA fiber, which comprises 1) first leading a PVA fiber that is swollen to contain from 20 to 300% by mass, relative to PVA, of a bath solvent, through a bath that contains from 10 to 200 g/liter of a copper ion-containing compound dissolved therein, thereby obtaining a fiber in which the copper ion-containing compound has uniformly infiltrated into the depth of the fiber, and 2) then leading the fiber through a bath that contains from 1 to 100 g/liter of a sulfide ion-containing compound dissolved therein to attain copper sulfurization and reduction in the next step, whereby fine copper sulfide nano-particles having a mean particle size of at most 50 nm are formed inside the fiber, and in which the overall draw ratio of the fiber in the whole process is at least 3 times.

The present invention also provides a conductive fabric comprising the fiber.

The content of bath solvent in the swollen PVA fiber includes all values and subvalues therebetween, especially including 30, 40, 50, 60, 70, 80, 90, 100, 110, 120, 130, 140, 150, 160, 170, 180, 190, 200, 210, 220, 230, 240, 250, 260, 270, 280, and 290% by mass, relative to PVA. The content of the copper ion-containing compound in the bath includes all values and subvalues therebetween, especially including 20, 30, 40, 50, 60, 70, 80, 90, 100, 110, 120, 130, 140, 150, 160, 170, 180, and 190 g/liter. The content of sulfide-ion containing compound in the bath includes all values and subvalues therebetween, especially including 5, 10, 15, 20, 25, 30, 35, 40, 45, 50, 55, 60, 65, 70, 75, 80, 85, 90 and 95 g/liter. The mean particle size of the copper sulfide nano-particles includes all values and subvalues between 0.1 and 50 nm, especially including 0.5, 1, 2, 3, 4, 5, 10, 15, 20, 25, 30, 35, 40 and 45 nm. The overall draw ratio of the fiber includes all values and subvalues between 3 and 30 times, especially including 4, 5, 6, 8, 10, 12, 14, 16, 18, 20, 22, 24, 26, and 28 times.

The present invention provides a PVA fiber which has good mechanical properties such as strength and elasticity and has good heat resistance and good conductivity. The PVA fiber of the present invention can be produced in a fiber-producing process not requiring any specific step, and therefore can be produced inexpensively. The PVA fiber can be processed into paper and fabric such as nonwoven fabric, woven fabric and knitted fabric. The fiber is extremely useful for many applications typically for charging materials, discharging materials, brushes, sensors, electromagnetic wave shields and electronic materials.

The present invention is described in detail below.

The PVA polymer which constitutes the PVA fiber of the present invention is described in the following. The degree of polymerization of the PVA polymer for use in the present invention is not specifically defined. In consideration of the mechanical properties and the dimensional stability of the fiber to be obtained, it is desirable that the mean degree of polymerization of the PVA polymer, as obtained from the viscosity thereof in an aqueous solution at 30° C., is from 1200 to 20000. The mean degree of polymerization includes all values and subvalues therebetween, especially including 1500, 2000, 2500, 3000, 3500, 4000, 4500, 5000, 5500, 6000, 6500, 7000, 7500, 8000, 8500, 9000, 9500, 10000, 10500, 11000, 11500, 12000, 12500, 13000, 13500, 14000, 14500, 15000, 15500, 16000, 16500, 17000, 17500, 18000, 18500, 19000, and 19500. The polymer having a higher degree of polymerization is preferable in view of the strength and the wet heat resistance of the fiber. However, in view of the polymer production cost and the fiber production cost, the mean degree of polymerization of the polymer is more preferably from 1500 to 5000.

The degree of saponification of the PVA polymer for use in the present invention is not also specifically defined. In view of the mechanical properties of the fiber to be obtained, it is preferably at least 88 mol %. The degree of saponification of the PVA polymer includes all values and subvalues therebetween, especially including 89, 90, 91, 92, 93, 94, 95, 96, 97, 98, 99 and 100 mol %. When a PVA polymer having a degree of saponification of lower than 88 mol % is used, then it is unfavorable in point of the mechanical properties of the fiber obtained and of the productivity and the production cost thereof.

Not specifically defined, the PVA polymer to form the fiber of the present invention may be any one having a vinyl alcohol unit as the essential ingredient thereof. If desired, the polymer may have any other constitutive unit, without interfering with the effect of the present invention. The additional constitutive unit includes, for example, olefins such as ethylene, propylene, butylene; acrylic acid and its salts, and acrylates such as methyl acrylate; methacrylic acid and its salts, and methacrylates such as methyl methacrylate; acrylamide and acrylamide derivatives such as N-methylacrylamide; methacrylamide and methacrylamide derivatives such as N-methylolmethacrylamide; N-vinylamides such as N-vinylpyrrolidone, N-vinylformamide, N-vinylacetamide; allyl ethers having a polyalkylene oxide in the side chain thereof; vinyl ethers such as methyl vinyl ether; nitriles such as acrylonitrile; vinyl halides such as vinyl chloride; unsaturated dicarboxylic acids such as maleic acid and its salts, anhydrides and esters. Introducing the modifying unit may be attained through copolymerization or through post-reaction. However, for obtaining the fiber of the present invention, a polymer having a vinyl alcohol unit content of at least 88 mol % is favorably used. The vinyl alcohol unit content includes all values and subvalues therebetween, especially including 89, 90, 91, 92, 93, 94, 95, 96, 97, 98, 99 and 100 mol %. Needless-to-say without interfering with the effect of the present invention, the polymer may contain additives such as antioxidant, freezing inhibitor, pH improver, masking agent, colorant, oil, and specific functional agent.

The fibers of the present invention contain copper sulfide nano-particles as the constitutive ingredient in addition to the above-mentioned PVA polymer. Specifically, copper sulfide nano-particles having a mean particle size of at most 50 nm are finely dispersed inside the fiber, and the content of the nano-particles in the fiber is at least 0.5% by mass/PVA polymer. As discussed above, fibers having copper sulfide particles adhered only to the surface of the fibers, as well as fibers containing large copper sulfide particles inside the fiber that are confirmed with the naked eye or with a stereoscopic microscope are outside the scope of the PVA fiber of the present invention. Such fibers can not exhibit conductivity. The specific morphology of the fiber of the present invention can be confirmed, for example, using a transmission electronic microscope (TEM).

In one embodiment, the PVA fiber of the present invention satisfies the following: copper sulfide nano-particles having a particle size of at most 50 nm are finely dispersed inside the fiber, and the degree of orientation of the PVA polymer is at least 60%. In this embodiment, a degree of orientation of the PVA polymer of less than 60% is unfavorable because the PVA fiber can hardly exhibit high conductivity and because the conductivity fluctuation between fibers will be great. In addition, another problem with the polymer of this type is that the heat resistance, the mechanical properties and the wet heat resistance of the fiber formed of the polymer are not good. Preferably, the degree of orientation of the polymer is at least 70%, more preferably at least 80%, since the polymer fiber may have further improved mechanical properties. The degree of orientation of the polymer is determined according to the method mentioned below.

Preferably, the PVA fiber of the present invention has a volume intrinsic resistivity of from $1\times10^{-3}$ to $1\times10^{8}$ Ω·m. Fibers having a volume intrinsic resistivity of higher than $1\times10^{8}$ Ω·m can not be conductive fibers, and can not be used for semiconductor materials. More preferably, the volume intrinsic resistivity of the PVA fiber of the present invention is from $1\times10^{-3}$ to $1\times10^{7}$ Ω·m. The intrinsic resistivity of the PVA fiber of the present invention may be controlled by controlling the amount of copper sulfide to be introduced into the fiber or by controlling the fiber structure such as the degree of orientation of the polymer for the fiber, as will be described below.

The conductive fiber of the present invention contains copper sulfide nano-particles in an amount of at least 0.5% by mass/PVA polymer, preferably in an amount of at least 1% by mass/PVA polymer. If the content of the copper sulfide nano-particles is smaller than 0.5% by mass/PVA polymer, then the fiber cannot have the desired conductivity.

On the other hand, however, if the content of the copper sulfide nano-particles is too large, then the mechanical properties and the abrasion resistance of the fiber will be unsatisfactory. Therefore, the content of the copper sulfide nano-particles in the fiber is preferably at most 50% by mass/PVA polymer, more preferably at most 40% by mass/PVA polymer.

The mean particle size of the copper sulfide nano-particles must be at most 50 nm, and is preferably at most 20 nm. The nano-particles of the type allows significant reduction in the particle-to-particle distance in the fiber. For example, it is known that, when the content is the same in terms of % by mass but when the particle size is reduced to 1/100, then the particle-to-particle distance is reduced to 1/10000. In such a case, in addition, it is also known that the interaction between the particles is extremely strong and therefore the polymer molecules sandwiched between the particles can function as if they were the same as the particles [e.g., see the World of Nano-Composites, p. 22 (by Kogyo Chosakai)]. Accordingly, by the nano-size effect that can be attained by the present invention, a tunnel current can more readily run through the structure, and even when the amount of the nano-particles added to the fiber is small, the fiber can still have good conductivity. On the other hand, if the mean particle size of the particles is larger than 50 nm, then the conductivity-improving effect of the particles is small for the same reason as above, and therefore the fiber containing the particles of that type can not be conducting.

A PVA polymer may strongly bond to a metal ion such as copper via its hydroxyl group in a mode of coordination-bonding therebetween [e.g., see Polymer, Vol. 37, No. 14, 3097 (1996)]. In the present invention, the intrinsic behavior of the PVA polymer is specifically noted, and the copper sulfide nano-particles are uniformly dispersed inside the polymer fiber. Specifically, the complex block formed by the PVA molecular chain and the copper ion in the fiber has a size of a few angstroms, and therefore it can be a constitutive unit of copper sulfide nano-particles that will be mentioned below. In one embodiment of the present invention, the copper ion is first infiltrated into the depth of the PVA fiber so that it can coordinate with the hydroxyl group of the PVA polymer and a coordination bond between PVA and copper is thereby formed. In order to attain it, the PVA fiber that is in a swollen condition with a bath solvent in the process of fiber production is led through a bath that contains a copper ion-containing compound dissolved therein, whereby copper ions are uniformly infiltrated into the depth of the fiber and are coordinated inside the fiber.

Next, the copper ions existing inside the PVA fiber and bonding to the hydroxyl group of the PVA polymer in a mode of coordination bonding are subjected to sulfurization and reduction to form copper sulfide nano-particles. Specifically, the fiber is processed for the copper ion infiltration treatment mentioned above, and then this is led through a bath of a sulfide ion-containing compound that has an ability of sulfurization and reduction, whereby the coordination bonding between the PVA polymer and the copper ion can be cut and the copper sulfide nano-particles can be formed inside the fiber. In order that the copper ions existing inside the fiber can be well subjected to sulfurization and reduction treatment in this stage, it is preferred that the fiber is swollen with the bath solvent, and it is desirable that the treatment is attained in a continuous mode. The treatment in this stage does not require any specific expensive step, and may be attained in an ordinary fiber production process.

Not specifically defined, the copper ion-containing compound for use in the present invention may be any compound that is soluble in the system. For example, it includes copper acetate, copper formate, copper nitrate, copper citrate, cuprous chloride, cupric chloride, cuprous bromide, cupric bromide, cuprous iodide, cupric iodide. Also not specifically defined, the copper ion may be either monovalent or divalent. When a monovalent copper ion-containing compound is used, then hydrochloric acid, potassium iodide or ammonia may be used along with it for the purpose of improving the solubility of the compound. Of the compounds mentioned above, preferred are those that can more readily bond to PVA polymer in solution in a mode of coordination bonding therebetween. From this viewpoint, copper acetate and copper formate are preferably used for the copper ion-containing compound.

The sulfurizing agent that sulfurizes and reduces the copper ion coordinated in the PVA fiber may be a compound capable of releasing a sulfide ion. For example, it includes sodium sulfide, sodium secondary thionate, sodium thiosulfate, sodium hydrogen sulfite, sodium pyrosulfate, hydrogen sulfide, thiourea, thioacetamide. Of those, sodium sulfide is preferred for the sulfide ion-containing compound for use herein in view of its cost, availability and corrosion resistance.

The conductive fiber of the present invention differs from conventional conductive fibers in that copper sulfide nano-particles are dispersed inside the fiber and the particle-to-particle distance in the fiber is extremely shortened. Therefore, when a current is made to run through the fiber, then the current amount may be increased, and the fiber has good conductivity. In addition, since the particle size of the particles in the fiber is small, it causes no problem in drawing the fiber. Concretely, the fiber of the present invention is comparable to PVA fibers not containing copper sulfide in point of the draw ratio and the mechanical properties.

Not specifically defined, the fineness of the fiber of the present invention may be, for example, from 0.1 to 10000 dtex, but preferably from 1 to 1000 dtex. The fineness of the fiber includes all values and subvalues therebetween, especially including 0.5, 1, 5, 10, 50, 100, 500, 1000, 1500, 2000, 2500, 3000, 3500, 4000, 4500, 5000, 5500, 6000, 6500, 7000, 7500, 8000, 8500, 9000 and 9500 dtex. The fineness of the fiber may be controlled by controlling the nozzle diameter for the fiber and the draw ratio of the fiber.

The PVA fiber of the present invention may be produced as follows. In the present invention, a PVA polymer is dissolved in water or an organic solvent to prepare a spinning solution, and this is spun into fibers according to the method mentioned below. The method is efficient and inexpensive, and the fiber thus produced contains copper sulfide nano-particles having a mean particle size of at most 50 nm and finely dispersed inside the particles, and it has good mechanical properties and good conductivity. The solvent for the spinning solution includes, for example, water; polar solvents such as dimethylsulfoxide (hereinafter abbreviated to DMSO), dimethylacetamide, dimethylformamide, N-methylpyrrolidone; polyalcohols such as glycerin, ethylene glycol; mixtures of such solvent with a swellable metal salt such as rhodanates, lithium chloride, calcium chloride, zinc chloride; mixtures of these solvents; and mixtures of the solvent with water. Of those, most preferred are water and DMSO in view of their cost and process compatibility such as recoverability.

The polymer concentration in the spinning solution varies, depending on the composition and the degree of polymerization of the polymer and on the solvent used. Preferably, it is from 8 to 60% by weight. The polymer concentration in the spinning solution includes all values and subvalues therebetween, especially including 10, 15, 20, 25, 30, 35, 40, 45, 50, and 55% by weight. The liquid temperature of the spinning solution just before spun is preferably within a range within which the solution is neither decomposed nor discolored. Concretely, the temperature preferably falls between 50 and 200° C. The temperature includes all values and subvalues therebetween, especially including 60, 70, 80, 90, 100, 110, 120, 130, 140, 150, 160, 170, 180, 190° C. Without interfering with the effect of the present invention, the spinning solution may contain various additives such as a flame retardant, an antioxidant, a freezing inhibitor, a pH improver, a masking agent, a colorant, an oil and a specific functional agent in accordance with the object of the present invention. One or more different types of such additives may be in the spinning solution.

The spinning solution is spun out through a nozzle in a mode of wet spinning, dry-wet spinning or dry spinning, into a coagulation bath having the ability to coagulate the PVA polymer or into air. Wet spinning is a method of spinning the spinning solution directly into a coagulation bath. Dry-wet spinning is a method of once spinning the spinning solution into an air zone or an inert gas zone having a predetermined distance and then introducing it into a coagulation bath. Dry spinning is a method of spinning the spinning solution into air or inert gas.

In the present invention, the coagulation bath used in the wet spinning or the dry-wet spinning process shall vary depending on the solvent for the spinning solution, either organic solvent or water. When an organic solvent is used for the spinning solution, then the solvent for the coagulation bath is preferably a mixture with the solvent for the spinning solution in view of the tenacity of the obtained fiber. Not specifically defined, the coagulant solvent may be an organic solvent having the ability to coagulate PVA polymer, and it includes, for example, alcohols such as methanol, ethanol, propanol, butanol; and ketones such as acetone, methyl ethyl ketone, methyl isobutyl ketone. Of those, preferred is a combination of methanol and DMSO in view of the corrosion resistance and the recoverability of the solvent. On the other hand, when the spinning solution is an aqueous solution, then the coagulant solvent for the coagulation bath may be an aqueous solution of an inorganic salt having the ability to coagulate PVA polymer, such as Glauber's salt, ammonium sulfate, sodium carbonate, or sodium hydroxide. An aqueous solution containing boric acid along with PVA polymer may be spun out into an alkaline coagulation bath in a mode of gellation spinning.

Next, the solvent is removed from the thus-solidified fiber through extraction, for which the fiber is led through an extraction bath. During the extraction, the fiber is preferably wet-drawn for preventing the fibers from being glued together while dried and for improving the mechanical properties of the fibers. The wet draw ratio is preferably from 2 to 10 times in view of the process capability and the productivity. The wet draw ratio includes all values and subvalues therebetween, especially including 2.5, 3, 3.5, 4, 4.5, 5, 5.5, 6, 6.5, 7, 7.5, 8, 8.5, 9 and 9.5 times. The extraction solvent may be the same as the coagulation bath solvent alone or may be a mixture of the solvent for the coagulation bath and the solvent for the spinning solution.

After thus wet-drawn, the fiber is dried and then optionally subjected to dry heat drawing and heat treatment. The drawing condition for it may be generally as follows: The temperature may be 100° C. or higher, preferably falling between 150° C. and 260° C. The temperature includes all values and subvalues therebetween, especially including 110, 120, 130, 140, 150, 160, 170, 180, 190, 200, 210, 220, 230, 240, and 250° C. The overall draw ratio may be at least 3 times, preferably falling between 5 and 25 times. In that condition, the degree of crystallinity and the degree of orientation of the fiber may increase and the mechanical properties of the fiber are significantly improved, and therefore the condition is preferable. If the temperature is lower than 100° C., then the fiber may be whitened and the mechanical and physical properties of the fiber may be thereby worsened. If higher than 260° C., the fiber may partly fuse and it is also unfavorable since the mechanical properties of the fiber may be thereby worsened. The draw ratio as referred to herein is a product of the above-mentioned wet draw ratio in the coagulation bath before the fiber is dried, and the draw ratio after dried. For example, when the wet draw ratio is 3 times and the subsequent dry-heat draw ratio is 2 times, then the overall draw ratio shall be 6 times.

For obtaining the conductive PVA fiber of the present invention, the fiber in a swollen condition after wet-drawn, or the dried or drawn fiber is led through a bath that contains a copper ion-containing compound dissolved therein to thereby infiltrate the compound into the fiber. In this case, in order that the copper ion-containing compound can be uniformly infiltrated into the depth of the fiber and the copper ion can bond to the hydroxyl group of the PVA polymer in a mode of coordination bonding, it is preferred that the fiber is swollen with the bath solvent. For this, it is desirable that the solvent for the bath is an alcohol such as methanol, water, a salt, or their mixture. Also preferably, the degree of swelling of the fiber with the bath solvent is at least 20% by mass. For controlling the degree of swelling, it may be desirable that the fiber is first dipped in a predetermined bath and then dipped in a bath that contains a copper ion-releasing compound dissolved therein. If the degree of swelling is smaller than 20% by mass, then the copper ion can not form a sufficient coordination bonding to the hydroxyl group of the PVA polymer and, as a result, copper sulfide nano-particles can not be formed in the depth of the fiber. On the other hand, if the degree of swelling is too large, the PVA polymer may dissolve in the solvent and it is unfavorable from the viewpoint of the fiber productivity. In view of the above, it is desirable that the degree of swelling of the fiber in the bath that contains a copper ion-containing compound dissolved therein is from 30% by mass to 300% by mass, more preferably from 50% by mass to 250% by mass. The degree of swelling of the fiber in the bath that contains a copper ion-containing compound dissolved therein includes all values and subvalues therebetween, especially including 25, 30, 35, 40, 45, 50, 60, 70, 80, 90, 100, 110, 120, 130, 140, 150, 160, 170, 180, 190, 200, 210, 220, 230, 240, 250, 260, 270, 280, and 290% by mass.

As so mentioned above, the volume intrinsic resistivity of the PVA fiber of the present invention can be suitably controlled by controlling the amount of copper sulfide to be introduced into the fiber and by controlling the fiber structure such as the degree of polymer orientation. The amount of the copper ion-containing compound to be dissolved in the bath may be suitably determined in accordance with the desired conductivity of the fiber. Preferably, it falls between 10 and 200 g/liter. If the amount is smaller than 10 g/liter, then the desired physical properties can not be obtained; but if larger than 200 g/liter, then it is unfavorable since the compound may adhere to rollers and may worsen the fiber process capability. More preferably, the amount falls between 20 and 100 g/liter. As so mentioned hereinabove, if the fiber is in a predetermined swollen condition and while it passes through a copper ion-containing bath in that condition, then the copper ion-containing compound begins to penetrate into the fiber. Therefore, the fiber residence time in the bath is not specifically defined. Preferably, it is at least 3 seconds, more preferably at least 30 seconds, most preferably at lest 1 minute in order that copper ions may uniformly disperse inside the fiber and may fully bond to the PVA polymer in a mode of coordination bonding.

Next, for the purpose of sulfurizing and reducing the copper ion that bonds to the PVA polymer in the surface of the PVA fiber and also inside the fiber in a mode of coordination bonding, the fiber must be led through a bath that contains a sulfide ion-containing compound dissolved therein. In this case, the amount of the sulfide ion-containing compound to be in the bath may be suitably determined in accordance with the necessity thereof. Preferably, it falls between 1 and 100 g/liter. If the amount is smaller than 1 g/liter, then the copper ions in the depth of the fiber can not be reduced. If larger than 100 g/liter, the amount may be enough for the reduction treatment of the copper ions inside the PVA fiber, but it is not so favorable in view of the fiber process capability since it may complicate the recovery system and may cause a problem of odor emission.

The reaction of sulfurizing the copper ions infiltrated into the fiber may occur instantaneously when a compound having an especially large sulfurization and reduction capability is used. Therefore, in such a case, the fiber residence time in the bath is not specifically defined. However, for the purpose of fully attaining the sulfurization and reduction treatment in depth of the fiber, the residence time is preferably 0.1 seconds or more, preferably at least 0.5 seconds, more preferably at least 1 second and most preferably at least 5 seconds.

For increasing the conductivity of the PVA fiber, it is effective to repeat the step of infiltrating copper ions into the depth of fibers and the step of sulfurizing and reducing the copper ions in the fibers at least one time to thereby increase the copper sulfide content of the fibers. When the copper ions once having coordinated with the PVA chain are sulfurized and reduced, then copper sulfide nano-particles are formed. In this step, the hydroxyl group having bonded to the copper ion in a mode of coordination bonding is restored, and, as a result, it becomes a free hydroxyl group that may again coordinate with copper. Preferably, the above-mentioned treatment is repeated at least two times, more preferably at least 3 times, most preferably at least 5 times whereby copper sulfide nano-particles may be effectively formed inside the fiber and the conductivity of the resulting fiber can be increased. Further, it is desirable that the fiber has a higher degree of orientation, or that is, the fiber has a higher overall draw ratio, since the conductivity of the fiber of the type can be more effectively increased. Though not clear at present, the reason may be as follows: When the fiber has a higher degree of orientation, then copper sulfide nano-particles may be formed aligned in the direction of the fiber axis and the particle-to-particle distance may be further shortened. The degree of orientation of the fiber as referred to herein is that of the fiber processed to contain copper ions therein. If the fiber that contains copper sulfide nano-particles formed therein is drawn, then the distance between the copper sulfide nanoparticles in the fiber may increase and the conductivity of the fiber may be thereby lowered, which is unfavorable.

On the other hand, if copper sulfide particles are put in the spinning solution, then nano-particles can not be dispersed in the fiber. In this case, a large amount of copper sulfide particles must be added to the solution in order that the fiber produced can exhibit the desired physical properties. In this case, therefore, there occur various problems in that the particles may insufficiently disperse in the spinning solution and may therefore aggregate or deposit therein, and therefore the fiber produced can not be well drawn in the subsequent step. As a result, the degree of crystallinity of the fiber may be low, and even if the fiber may have some conductivity, its mechanical properties are not good. If a PVA polymer previously coordinated with a copper ion is used as the starting material, then the polymer solution viscosity may increase due to the copper coordination with the polymer and the coagulation of the spinning solution may be poor, and therefore the fiber process capability may be poor. In addition, the mechanical properties of the fibers obtained will be poor.

The thus-obtained, unstretched or stretched fiber that contains copper sulfide nano-particles introduced thereinto may be subjected to heat treatment so as to improve the physical properties of the fiber. In that manner, the conductive PVA fiber of the present invention can be produced. Regarding the condition for the heat treatment, the temperature may be generally 100° C. or higher, but preferably falls between 150° C. and 260° C. The temperature includes all values and subvalues therebetween, especially including 100, 110, 120, 130, 140, 150, 160, 170, 180, 190, 200, 210, 220, 230, 240, and 250° C. If the temperature is lower than 100° C., the physical properties of the fiber can not be satisfactorily improved. If higher than 260° C., the fiber may partly fuses and it is also unfavorable since the mechanical properties of the fiber may be thereby worsened.

The fiber of the present invention exhibits excellent conductivity in any fiber form of, for example, staple fibers, short-cut fibers, filament yarns, spun yarns, strings, ropes and fabrics, and is therefore applicable to sensors and electromagnetic shields. The cross-section profile of the fiber is not specifically defined, and the fiber may have a circular or hollow cross-section, or a modified cross-section such as a star-shaped cross-section. In particular, since the PVA fiber of the present invention has good conductivity and flexibility, it is favorable to conductive fabrics. For example, a fabric containing at least 50% by weight, preferably at least 80% by weight, more preferably at least 90% by weight of the PVA fiber of the present invention may be a PVA fiber product of high conductivity. The fiber to be combined with the PVA fiber is not specifically defined, and includes, for example, PVA fiber not containing copper sulfide particles, as well as polyester fibers, polyamide fibers and cellulose fibers.

Since the fiber of the present invention has good mechanical properties and good heat resistance, and additionally has good flexibility and good conductivity, it can be worked into filaments, spun yarns and also into paper, fabrics such as nonwoven fabrics, woven fabrics and knitted fabrics. Accordingly, the fiber is favorably used in various applications for industrial materials, clothing, medical appliances. For example, it is extremely useful for many applications such as typically charging materials, discharging materials, brushes, sensors, electromagnetic wave shields and electronic materials.

Having generally described this invention, a further understanding can be obtained by reference to certain specific examples which are provided herein for purposes of illustration only, and are not intended to be limiting unless otherwise specified.

EXAMPLES

The invention is described in more detail with reference to the following Examples, to which, however, the invention should not be limited. In the following Examples, the amount of the copper sulfide nano-particles in the fiber, the existing morphology and the particle size thereof, the degree of swelling of the fiber, the volume intrinsic resistivity of the fiber and the tensile strength of the fiber are determined according to the methods mentioned below.

Quantitative Determination of Copper Sulfide Nano-Particles in Fiber, % by Mass

The copper sulfide nano-particles in the fiber was quantitatively determined by the use of an ICP emission analyzer, Jarrel Ash's IRIS-AP.

Existing Morphology and Mean Particle Size of Copper Sulfide Nano-particles in Fiber, nm The existing morphology of copper sulfide nano-particles in the fiber was confirmed by the use of a transmission electronic microscope (TEM), Hitachi's H-800NA. Briefly, 100 copper sulfide nano-particles were randomly sampled in the cross section of the fiber in the photographic picture, and their size was individually measured. The data were averaged to obtain the mean particle size of the particles.

Degree of Orientation of Fiber, ft

The sound speed through the fiber, which is an index of the degree of orientation of all molecules constituting the fiber, was determined by the use of Rheovibron's DDV-5-B. Briefly, a fiber bundle having a fiber length of 50 cm was fixed to the device, and the sound wave propagation speed was measured at different points of 50, 40, 30, 20 and 10 cm of from the sound source to the detector. From the relation between the distance and the propagation time, the sound speed was obtained. From the thus-obtained sound speed, the degree of orientation (ft) of all molecules constituting the fiber was calculated according to the following formula:

$$ft\ (\%)=(1-(Cu/C)^2)\times 100,$$

wherein Cu indicates the sound speed value through a non-oriented PVA polymer (2.2 km/sec), C indicates the actually-measured sound speed through the sample (km/sec).

Determination of Degree of Swelling in Bath, % by Mass

The fiber was taken out of a bath that contains a copper ion-containing compound dissolved therein, and its surface was wiped with tissue paper to remove the adhered water from it. The wiping operation was repeated until the tissue paper used was no more wetted. Thus processed, the fiber was in a swollen condition. From the mass change before and after drying, the degree of swelling of the fiber was determined according to the following formula:

$$\text{Degree of Swelling } (\%)=[(\text{mass of swollen fiber before dried}-\text{mass of fiber after dried})/(\text{mass of fiber after dried})]\times 100.$$

Determination of Conductivity (Volume Intrinsic Resistivity) of Fiber, Ω·m

The PVA fiber was dried for 1 hour at a temperature 105° C., and then left at a temperature of 20° C. and at a humidity of 30% for 24 hours or more, whereby the fiber was thus conditioned under the condition. A single fiber sample having a length of 2 cm was collected from the thus-conditioned fiber. Using an ohm meter, Yokogawa-Hewlett Packard's MULTIMETER, a voltage of 10 V was applied between the two ends of the sample, and the resistance (Ω) of the sample was measured. The volume intrinsic resistivity (ρ)(Ω·m) is represented by (ρ)(Ω·m)=R×(S/L). The volume intrinsic resistivity of each sample was obtained. 25 samples were thus tested and their data were averaged to obtain the volume intrinsic resistivity of the fiber. In the formula, R indicates the resistance (Ω) of the sample; S indicates the cross section ($cm^2$) of the sample; and L indicates the length (2 cm) of the sample. The cross section of the sample was calculated by observing the fiber with a microscope.

Determination of Electromagnetic Wave Shield, dB

The electromagnetic wave shield property of the fiber was determined according to a Kansai Electronic Industry Promotion Center method (KEC method). The temperature was 24° C.; the frequency was from 10 to 1000 MHz; and the distance between the wave-sending part and the wave-receiving site was 5 mm. An average of n=5 was obtained. Comparing the samples in point the electromagnetic wave shield property (dB) thereof at 100 MHz, the presence or absence of the effect of the sample was confirmed. 20 dB means that the sample can shield 90% of the emitted electromagnetic waves; 40 dB means that the sample can shield 99% thereof; and 60 dB means that the sample can shield 99.9% thereof.

Fiber Strength, cN/dtex

According to JIS L1013, a previously-conditioned yarn sample having a length of 20 cm was tested under an initial load of 0.25 cN/dtex and at a pulling rate of 50%/min. An average of n=20 was obtained. The fiber fineness (dtex) was determined according to a mass process.

Example 1

(1) PVA having a degree of viscosity-average polymerization of 1700 and a degree of saponification of 99.8 mol % was added to DMSO to have a PVA concentration of 23% by mass, and dissolved under heat at 90° C. in a nitrogen atmosphere. Thus obtained, the spinning solution was spun in a mode of dry-wet spinning through a nozzle with 108 holes each having a hole diameter of 0.08 mm, into a coagulation bath of methanol/DMSO=70/30 (by mass) at 5° C.

(2) The thus-solidified fiber was dipped in a second bath having the same methanol/DMSO composition as that of the coagulation bath, and then wet-drawn 6-fold in a methanol bath at 25° C. Next, this was led into a water bath at 25° C. containing 50 g/liter of copper acetate (by Wako Jun-yaku) dissolved therein, taking a residence time therein of 120 seconds, and then led into a water bath at 25° C. containing 50 g/liter of sodium sulfide (by Wako Jun-yaku) therein, taking a residence time therein of 120 seconds. Further, to prevent the fibers from gluing together, the fiber was led through a methanol bath at 25° C., and then dried with hot air at 120° C. Thus obtained, the fiber was tested and evaluated, and its results are given in Table 1.

(3) The content of the copper sulfide nano-particles in the fiber obtained herein was 2.81% by mass; and the mean particle size of the particles was 7.0 nm. For reference, a TEM picture of the fiber is shown in FIG. 1. The degree of orientation of the fiber was 72%. The degree of swelling of the fiber in the bath was 200% by weight. The physical properties of the fiber were as follows: The single fiber fineness was 10.0 dtex; the fiber elasticity and tenacity were 90 cN/dtex and 5.0 cN/dtex, respectively; and the volume intrinsic resistivity of the fiber was $2.0\times10^1$ Ω·m. The fiber had a good outward appearance with no surface mottle. The fiber had good mechanical properties of ordinary PVA fibers and had good conductivity.

(4) The fiber of Example 1 was brushed 100 times with a commercial toothbrush, but it still kept its mechanical properties and conductivity. This confirms excellent durability of the fiber.

Example 2

(1) The fiber obtained in the same dry-wet spinning process as in Example 1 was dried with hot air at 120° C., and then drawn in a hot-air fiber-drawing furnace at 235° C. up to an overall draw ratio (wet draw ratio×hot air furnace draw ratio) of 13 times.

(2) Thus obtained, the fiber was led into a water bath at 25° C. containing 50 g/liter of copper acetate (by Wako Jun-yaku) dissolved therein, taking a residence time therein of 120 seconds, and then led into a water bath at 25° C. containing 50 g/liter of sodium sulfide (by Wako Jun-yaku) therein, taking a residence time therein of 120 seconds. This process repeated 4 times, and then the fiber was dried with hot air at 120° C.

(3) The content of the copper sulfide nano-particles in the fiber obtained herein was 7.25% by mass; and the mean particle size of the particles was 8.0 nm. The degree of orientation of the fiber was 93%. The degree of swelling of the fiber in the bath was 60% by weight. The physical properties of the fiber were as follows: The single fiber fineness was 2.0 dtex; the fiber elasticity and tenacity were 198 cN/dtex and 7.0 cN/dtex, respectively; and the volume intrinsic resistivity of the fiber was $7.0\times10^{0}$ Ω·m. The fiber had a good outward appearance with no surface mottle. The fiber had good mechanical properties of ordinary PVA fibers and had good conductivity.

(4) The fiber of Example 2 was brushed 100 times with a commercial toothbrush, but it still kept its mechanical properties and conductivity. This confirms excellent durability of the fiber.

Example 3

A fiber was obtained under the same spinning condition as in Example 1, for which, however, the copper acetate and sodium sulfide bath concentration was 5 g/liter. Thus obtained, the fiber was tested and evaluated, and its results are given in Table 1. The content of the copper sulfide nano-particles in the fiber obtained herein was 0.71% by mass; and the mean particle size of the particles was 5.0 nm. The degree of orientation of the fiber was 70%. The degree of swelling of the fiber in the bath was 200% by weight. The physical properties of the fiber were as follows: The single fiber fineness was 10.2 dtex; the fiber elasticity and tenacity were 100 cN/dtex and 4.5 cN/dtex, respectively; and the volume intrinsic resistivity of the fiber was $8.0\times10^{7}$ Ω·m. The fiber had a good outward appearance with no surface mottle. The fiber had good mechanical properties of ordinary PVA fibers and had good conductivity.

Example 4

A fiber was obtained under the same spinning condition as in Example 1, for which, however, the treatment through the copper acetate-containing bath followed by the subsequent treatment through the sodium sulfide-containing bath was repeated 6 times. Thus obtained, the fiber was tested and evaluated, and its results are given in Table 1. The content of the copper sulfide nano-particles in the fiber obtained herein was 16.5% by mass; and the mean particle size of the particles was 8.0 nm. The degree of orientation of the fiber was 74%. The degree of swelling of the fiber in the bath was 200% by weight. The physical properties of the fiber were as follows: The single fiber fineness was 11.1 dtex; the fiber elasticity and tenacity were 85 cN/dtex and 3.7 cN/dtex, respectively; and the volume intrinsic resistivity of the fiber was $8.0\times10^{-1}$ Ω·m. The fiber had a good outward appearance with no surface mottle. The fiber had good mechanical properties of ordinary PVA fibers and had good conductivity.

Example 5

A fiber was obtained under the same spinning condition as in Example 1, for which, however, the residence time in the copper acetate-containing water bath was 60 seconds and the residence time in the sodium sulfide-containing water bath was 3 seconds. Thus obtained, the fiber was tested and evaluated, and its results are given in Table 1. The content of the copper sulfide nano-particles in the fiber obtained herein was 3.0% by mass; and the mean particle size of the particles was 8.0 nm. The degree of orientation of the fiber was 70%. The degree of swelling of the fiber in the bath was 200% by weight. The physical properties of the fiber were as follows: The single fiber fineness was 10.6 dtex; the fiber elasticity and tenacity were 119 cN/dtex and 4.3 cN/dtex, respectively; and the volume intrinsic resistivity of the fiber was $6.0\times10^{1}$ Ω·m. The fiber had a good outward appearance with no surface mottle. The fiber had good mechanical properties of ordinary PVA fibers and had good conductivity.

Example 6

(1) A fiber was obtained under the same spinning condition as in Example 4, for which, however, PVA having a degree of polymerization of 2400 and a degree of saponification of 98.0 mol % was used.

(2) The content of the copper sulfide nano-particles in the fiber obtained herein was 17.4% by mass; and the mean particle size of the particles was 9.0 nm. The degree of orientation of the fiber was 75%. The degree of swelling of the fiber in the bath was 190% by weight. The physical properties of the fiber were as follows: The single fiber fineness was 12.0 dtex; the fiber elasticity and tenacity were 140 cN/dtex and 5.0 cN/dtex, respectively; and the volume intrinsic resistivity of the fiber was $2.0\times10^{-2}$ Ω·m. The fiber had a good outward appearance with no surface mottle. The fiber had good mechanical properties of ordinary PVA fibers and had good conductivity.

Example 7

(1) PVA having a degree of viscosity-average polymerization of 1700 and a degree of saponification of 99.8 mol % was added to water to have a PVA concentration of 16% by mass, and dissolved under heat at 90° C. in a nitrogen atmosphere. Thus obtained, the spinning solution was wet-spun through a nozzle with 108 holes each having a hole diameter of 0.16 mm, into a coagulation bath comprising an aqueous solution of saturated Glauber's salt.

(2) The thus-obtained fiber was wet-drawn 5-fold in water, and led into a water bath at 25° C. containing 50 g/liter of copper acetate (by Wako Jun-yaku) dissolved therein, taking a residence time therein of 120 seconds, and then into a water bath at 25° C. containing 50 g/liter of sodium sulfide (by Wako Jun-yaku) therein, taking a residence time therein of 120 seconds. This treatment was repeated 6 times, and then dried with hot air at 120° C. Thus obtained, the fiber was tested and evaluated, and its results are given in Table 1.

(3) The content of the copper sulfide nano-particles in the fiber obtained herein was 15.6% by mass; and the mean particle size of the particles was 9.0 nm. The degree of orientation of the fiber was 65%. The degree of swelling of the fiber in the bath was 150% by weight. The physical properties of the fiber were as follows: The single fiber fineness was 10.6 dtex; the fiber elasticity and tenacity were 80 cN/dtex and 5.1 cN/dtex, respectively; and the volume intrinsic resistivity of the fiber was $4.0\times10^{1}$ Ω·m. The fiber had a good outward appearance with no surface mottle. The fiber had good mechanical properties of ordinary PVA fibers and had good conductivity.

Example 8

(1) PVA having a degree of viscosity-average polymerization of 1700 and a degree of saponification of 99.8 mol % was watered to have a PVA concentration of 50% by mass, then heated at 165° C. through an extruder, and thereafter dry-spun into air through a nozzle with 200 holes each having a hole diameter of 0.1 mm. This was wound up with a fiber winder at a speed of 160 m/min, and then drawn in a hot air drawing furnace at 230° C. up to an overall draw ratio (wet draw ratio×hot air furnace draw ratio) of 10.5 times.

(2) The thus-obtained fiber was led into a water bath at 25° C. containing 20 g/liter of copper acetate (by Wako Jun-yaku) dissolved therein, taking a residence time therein of 120 seconds, and then into a water bath at 25° C. containing 20 g/liter of sodium sulfide (by Wako Jun-yaku) therein, taking a residence time therein of 120 seconds. Thus processed, the fiber was dried with hot air at 120° C.

(3) The content of the copper sulfide nano-particles in the fiber obtained herein was 1.02% by mass; and the mean particle size of the particles was 9.2 nm. The degree of orientation of the fiber was 82%. The degree of swelling of the fiber in the bath was 40% by weight. The physical properties of the fiber were as follows: The single fiber fineness was 13.0 dtex; the fiber elasticity and tenacity were 120 cN/dtex and 6.4 cN/dtex, respectively; and the volume intrinsic resistivity of the fiber was $9.0\times10^{6}$ Ω·m. The fiber had a good outward appearance with no surface mottle. The fiber had good mechanical properties of ordinary PVA fibers and had good conductivity.

Example 9

The conductive PVA fiber obtained in Example 2 was formed into a woven fabric having a substrate fabric density of 50 yarns/10 cm in the warp and 50 yarns/10 cm in the weft and having a woven width of 20 cm×20 cm. The electromagnetic wave shielding capability at 100 MHz of the thus-obtained fabric was 43 dB, and was good.

Comparative Example 1

A fiber was obtained under the same spinning condition as in Example 1, which, however, was led through the copper acetate-containing bath but not through the sodium sulfide-containing bath. Thus obtained, the fiber was tested and evaluated, and its results are given in Table 2. The fiber had a good outward appearance with no surface mottle. The degree of orientation of the fiber was 74%. The single fiber fineness was 10.1 dtex, and the fiber elasticity and tenacity were 134 cN/dtex and 5.1 cN/dtex, respectively. However, the fiber did not contain copper sulfide, and its volume intrinsic resistivity was $2.0\times10^{13}$ Ω·m. The fiber had poor conductivity.

Comparative Example 2

A fiber was obtained under the same spinning condition as in Example 1, which, however, was wet-drawn 1.1-fold. Thus obtained, the fiber was tested and evaluated, and its results are given in Table 2. The fiber had a good outward appearance with no surface mottle. The single fiber fineness was 18.5 dtex. The degree of swelling of the fiber in the bath was 230% by mass; the content of the copper sulfide nano-particles in the fiber was 2.51% by mass; the mean particle size of the particles was 18.0 nm. However, the degree of orientation of the fiber was 30%; and the fiber elasticity and tenacity were 40 cN/dtex and 0.5 cN/dtex, respectively. The volume intrinsic resistivity of the fiber was $2.0\times10^{9}$ ∩·m. Both the mechanical properties and the conductivity of the fiber were poor.

Comparative Example 3

A fiber was obtained under the same spinning condition as in Example 1, for which, however, the copper acetate concentration was 0.1 g/liter and the sodium sulfide concentration was 0.1 g/liter. Thus obtained, the fiber was tested and evaluated, and its results are given in Table 2. The degree of orientation of the fiber was 70%. Some copper sulfide nano-particles having a size of about 5.0 nm were seen partly inside the fiber, but the content of the nano-particles in the fiber was 0.01% by mass. The degree of swelling of the fiber in the bath was 200% by mass. The physical properties of the fiber were as follows: The single fiber fineness was 10.0 dtex; and the fiber elasticity and tenacity were 110 cN/dtex and 4.5 cN/dtex, respectively. The fiber had a good outward appearance with no surface mottle. However, since the amount of the copper sulfide nano-particles introduced into the fiber was small, the volume intrinsic resistivity of the fiber was $8.0\times10^{10}$ Ω·m, and the conductivity of the fiber was low.

Comparative Example 4

A fiber was obtained under the same spinning condition as in Comparative Example 1, for which, however, copper sulfide particles were added to the spinning solution. Briefly, an aqueous solution of 50 g/liter of copper acetate (by Wako Jun-yaku) and an aqueous solution of 50 g/liter of sodium sulfide (by Wako Jun-yaku) were mixed to give a deposit of copper sulfide particles having a secondary particle size of about 10 μm. This was well washed with water, and then dried at 80° C. This was added to PVA in a ratio of 30% by weight to PVA to prepare a spinning solution. In the thus-obtained fiber, the content of the copper sulfide particles is 28.8% by mass, but the volume intrinsic resistivity of the fiber was $2.0\times10^{9}$ Ω·m. Inside the fiber, the mean particle size of the copper sulfide particles was 5 μm, and the particles partly aggregated inside the fiber. Accordingly, the fiber had surface mottles, and, in addition, its elasticity and tenacity were 20 cN/dtex and 1.0 cN/dtex, respectively, and were both low. While the fiber was produced and processed, the filter pressure increased within a short period of time, and this means that the fiber processability is poor.

Comparative Example 5

(1) A commercial nylon-6 fiber was led into a water bath at 25° C. containing 50 g/liter of copper acetate (by Wako Jun-yaku), taking a residence time of 120 seconds, and then to a water bath at 25° C. containing 50 g/liter of sodium sulfide, taking a residence time of 120 seconds. This operation was repeated four times, and then the fiber was dried with hot air at 120° C.

(2) Thus obtained, the fiber had a copper sulfide content of 0.5% by mass, in which, however, copper sulfide particles having a size of 1 μm or so adhered to the surface thereof as large aggregated particles thereof. The degree of orientation of the fiber was 80%, but the fiber had a volume intrinsic resistivity of $4.0\times10^{10}$ Ω·m. When the fiber was brushed 100 times with a commercial brush, then the copper sulfide peeled off from the surface of the fiber.

Comparative Example 6

The PVA fiber obtained in Comparative Example 4 was formed into a woven fabric having a substrate fabric density of 50 yarns/10 cm in the warp and 50 yarns/10 cm in the weft and having a woven width of 20 cm×20 cm. The electromagnetic wave shielding capability at 100 MHz of the thus-obtained fabric was 1 dB, and was poor.

Comparative Example 7

The nylon-6 fiber obtained in Comparative Example 5 was formed into a woven fabric having a substrate fabric density of 50 yarns/10 cm in the warp and 50 yarns/10 cm in the weft and having a woven width of 20 cm×20 cm. The electromagnetic wave shielding capability at 100 MHz of the thus-obtained fabric was 2 dB, and was poor.

TABLE 1

| | | Example 1 | Example 2 | Example 3 | Example 4 | Example 5 | Example 6 | Example 7 | Example 8 |
|---|---|---|---|---|---|---|---|---|---|
| Polymer Component | type of polymer | PVA | PVA | PVA | PVA | PVA | PVA | PVA | PVA |
| | degree of saponification (mol %) | 99.8 | 99.8 | 99.8 | 99.8 | 99.8 | 98.0 | 99.8 | 99.8 |
| | degree of polymerization | 1700 | 1700 | 1700 | 1700 | 1700 | 2400 | 1700 | 1700 |
| Condition for Fiber Formation | spinning method | dry/wet spinning | dry/wet spinning | dry/wet spinning | dry/wet spinning | dry/wet spinning | dry/wet spinning | wet spinning | dry spinning |
| | solvent for spinning solution | DMSO | DMSO | DMSO | DMSO | DMSO | DMSO | water | water |
| | draw ratio (times) | 6 | 13 | 6 | 6 | 6 | 6 | 5 | 12 |
| Bath Composition 1 | copper ion-containing compound | copper acetate | copper acetate | copper acetate | copper acetate | copper acetate | copper acetate | copper acetate | copper acetate |
| | amount of the compound added (g/liter) | 50 | 50 | 5 | 50 | 50 | 50 | 50 | 20 |
| | bath residence time (sec) | 120 | 120 | 120 | 120 | 60 | 120 | 120 | 120 |
| | degree of swelling (mas. %) | 200 | 60 | 200 | 200 | 200 | 190 | 150 | 40 |
| Bath Composition 2 | sulfide ion-containing compound | sodium sulfide | sodium sulfide | sodium sulfide | sodium sulfide | sodium sulfide | sodium sulfide | sodium sulfide | sodium sulfide |
| | amount of the compound added (g/liter) | 50 | 50 | 5 | 50 | 50 | 50 | 50 | 20 |
| | bath residence time (sec) | 120 | 120 | 120 | 120 | 3 | 120 | 120 | 120 |
| | degree of swelling (mas. %) | 200 | 60 | 200 | 200 | 200 | 190 | 150 | 40 |
| Number of Repetitions of Treatment | number of treatments (times) | 1 | 4 | 1 | 6 | 1 | 6 | 6 | 1 |
| Fiber Properties | degree of orientation (%) | 72 | 93 | 70 | 74 | 70 | 75 | 65 | 82 |
| | content of copper sulfide (mas. %/PVA) | 2.81 | 7.25 | 0.71 | 16.5 | 3.0 | 17.4 | 15.6 | 1.02 |
| | single fiber fineness (dtex) | 10.0 | 2.0 | 10.2 | 11.1 | 10.6 | 12.0 | 10.6 | 13.0 |
| | mean particle size of copper sulfide (nm) | 7.0 | 8.0 | 5.0 | 8.0 | 8.0 | 9.0 | 9.0 | 9.2 |
| | fiber tenacity (cN/dtex) | 5.0 | 7.0 | 4.5 | 3.7 | 4.3 | 5.0 | 5.1 | 6.4 |
| | fiber elasticity (cN/dtex) | 90 | 198 | 100 | 85 | 119 | 140 | 80 | 120 |
| | volume intrinsic resistivity (Ω · cm) | $2\times10^{1}$ | $7\times10^{0}$ | $8\times10^{7}$ | $8\times10^{-1}$ | $6\times10^{1}$ | $2\times10^{-2}$ | $4\times10^{1}$ | $9\times10^{6}$ |

TABLE 2

| | | Comp. Ex. 1 | Comp. Ex. 2 | Comp. Ex. 3 | Comp. Ex. 4 | Comp. Ex. 5 |
|---|---|---|---|---|---|---|
| Polymer Component | type of polymer | PVA | PVA | PVA | PVA | Nylon-6 |
| | degree of saponification (mol %) | 99.8 | 99.8 | 99.8 | 99.8 | — |
| | degree of polymerization | 1700 | 1700 | 1700 | 1700 | — |
| Condition for Fiber Formation | spinning method | dry/wet spinning | dry/wet spinning | dry/wet spinning | dry/wet spinning | — |
| | solvent for spinning solution | DMSO | DMSO | DMSO | DMSO | — |
| | draw ratio (times) | 6 | 1.1 | 6 | 6 | — |
| Bath Composition 1 | copper ion-containing compound | copper acetate | copper acetate | copper acetate | — | copper acetate |
| | amount of the compound added (g/liter) | 50 | 50 | 0.1 | — | 50 |
| | bath residence time (sec) | 120 | 120 | 120 | — | 120 |
| | degree of swelling (mas. %) | 200 | 230 | 200 | — | 10 |

TABLE 2-continued

| | | Comp. Ex. 1 | Comp. Ex. 2 | Comp. Ex. 3 | Comp. Ex. 4 | Comp. Ex. 5 |
|---|---|---|---|---|---|---|
| Bath Composition 2 | sulfide ion-containing compound | — | sodium sulfide | sodium sulfide | — | sodium sulfide |
| | amount of the compound added (g/liter) | — | 50 | 0.1 | — | 50 |
| | bath residence time (sec) | — | 120 | 120 | — | 120 |
| | degree of swelling (mas. %) | — | 230 | 200 | — | 10 |
| Number of Repetitions of Treatment | number of treatments (times) | — | 1 | 1 | — | 4 |
| Fiber Properties | degree of orientation (%) | 74 | 30 | 70 | 62 | 80 |
| | content of copper sulfide (mas. %/PVA) | — | 2.51 | 0.01 | 28.8 | 0.5 |
| | single fiber fineness (dtex) | 10.1 | 18.5 | 10.0 | 15.0 | — |
| | mean particle size of copper sulfide (nm) | — | 18.0 | 5.0 | 5000 | 1000 |
| | fiber tenacity (cN/dtex) | 5.1 | 0.5 | 4.5 | 1.0 | — |
| | fiber elasticity (cN/dtex) | 134 | 40 | 110 | 20 | — |
| | volume intrinsic resistivity (Ω · cm) | $2 \times 10^{13}$ | $2 \times 10^{9}$ | $8 \times 10^{10}$ | $2 \times 10^{9}$ | $4 \times 10^{10}$ |

As can be seen from the results in Table 1 and FIG. 1, the PVA fiber of the present invention contained copper nano-particles dispersed inside it, and it had good mechanical properties intrinsic to PVA and additionally had good conductivity. On the other hand, when the content of the copper sulfide nano-particles in the fiber was small, or when the degree of orientation of the fiber was low, or when copper sulfide particles were added to the spinning solution, or even when a fiber having a low degree of swelling was processed in the same manner as in the invention, the fiber produced can not have good mechanical properties and good conductivity like the fiber of the invention, as is seen from the results in Table 2 and FIG. 2.

As described in detail hereinabove with reference to its preferred embodiments, the present invention has made it possible to provide a PVA fiber having both good mechanical properties and good conductivity, though no one has heretofore succeeded in producing it. Not requiring any specific and expensive step, the PVA fiber of the present invention can be produced in an ordinary inexpensive spinning and drawing process. Further, the PVA fiber of the present invention can be formed into paper or fabrics such as nonwoven fabrics, woven fabrics and knitted fabrics, and may have many applications typically for charging materials, discharging materials, brushes, sensors, electromagnetic wave shields, electronic materials, etc.

Japanese patent application 41,041/2004 filed Feb. 18, 2004, is incorporated herein by reference.

Numerous modifications and variations on the present invention are possible in light of the above teachings. It is therefore to be understood that within the scope of the appended claims, the invention may be practiced otherwise than as specifically described herein.

The invention claimed is:

1. A conductive polyvinyl alcohol fiber, comprising:

a polyvinyl alcohol polymer; and copper sulfide nano-particles having a mean particle size of at most 50 nm which are finely dispersed in the polymer;

wherein the content of the nano-particles in the fiber is at least 0.5% by mass/polyvinyl acohol polymer; and wherein a degree of polymer orientation is at least 60%.

2. The conductive polyvinyl alcohol fiber as claimed in claim 1, which has a volume intrinsic resistivity of from $1.0\times10^{-3}$ to $1.0\times10^{8}$ Ω·m.

3. The conductive polyvinyl alcohol fiber as claimed in claim 1, wherein the content of the copper sulfide nano-particles in the fiber is from 0.5 to 50% by mass/polyvinyl alcohol polymer.

4. The conductive polyvinyl alcohol fiber as claimed in claim 1, wherein a mean degree of polymerization of the polyvinyl alcohol polymer, as obtained from the viscosity thereof in an aqueous solution at 30° C., is from 1200 to 20000.

5. The conductive polyvinyl alcohol fiber as claimed in claim 1, wherein a degree of saponification of the polyvinyl alcohol polymer is at least 88 mol %.

6. The conductive polyvinyl alcohol fiber as claimed in claim 1, wherein said polymer is a copolymer.

7. The conductive polyvinyl alcohol fiber as claimed in claim 1, which has a vinyl alcohol unit content of at least 88 mol %.

8. The conductive polyvinyl alcohol fiber as claimed in claim 1, wherein said nano-particles are uniformly dispersed in said polymer.

9. The conductive polyvinyl alcohol fiber as claimed in claim 1, having a fineness of from 0.1 to 10000 dtex.

10. A method for producing the conductive polyvinyl alcohol fiber of claim 1, comprising:

1) leading a polyvinyl alcohol fiber that is swollen to contain from 20 to 300% by mass, relative to polyvinyl alcohol, of a bath solvent, through a bath that contains from 10 to 200 g/liter of a copper ion-containing compound dissolved therein, thereby obtaining a fiber in which the copper ion-containing compound has uniformly infiltrated into the depth of the fiber, and 2) leading the fiber through a bath that contains from 1 to 100 g/liter of a sulfide ion-containing compound dissolved therein to attain copper sulfurization and reduction, thereby forming fine copper sulfide nano-particles having a mean particle size of at most 50 nm inside the fiber, wherein an overall draw ratio of the fiber in said process is at least 3 times.

11. The method according to claim 10, wherein said bath solvent is an alcohol or a mixture of alcohols.

12. The method according to claim 10, wherein a fiber residence time in the bath containing the copper-ion containing compound is at least 3 seconds.

13. The method according to claim 10, wherein a residence time of the fiber during the sulfurization and reduction is 0.1 seconds or more.

14. The method according to claim 10, wherein steps 1) and 2) are repeated at least one time.

15. The method according to claim 10, further comprising heat treatment.

16. The method according to claim 10, further comprising heat treatment at a temperature of 100° C. or higher.

17. A conductive fabric, comprising:

the conductive polyvinyl alcohol fiber of claim 1.

18. The conductive fabric according to claim 17, comprising at least 50% by weight of said fiber.

19. The conductive fabric as claimed in claim 17, wherein said fiber has a volume intrinsic resistivity of from $1.0\times10^{-3}$ to $1.0\times10^{8}$ Ω·m.

20. The conductive fabric as claimed in claim 17, wherein said fiber has a content of the copper sulfide nano-particles of from 0.5 to 50% by mass/polyvinyl alcohol polymer.

* * * * *